US006341274B1

(12) United States Patent
Leon

(10) Patent No.: US 6,341,274 B1
(45) Date of Patent: Jan. 22, 2002

(54) METHOD AND APPARATUS FOR OPERATING A SECURE METERING DEVICE

(75) Inventor: J P Leon, San Carlos, CA (US)

(73) Assignee: Neopost Inc., Hayward, CA (US)

( * ) Notice: Subject to any disclaimer, the term of this patent is extended or adjusted under 35 U.S.C. 154(b) by 0 days.

(21) Appl. No.: 09/359,158

(22) Filed: Jul. 21, 1999

Related U.S. Application Data

(63) Continuation of application No. 09/250,990, filed on Feb. 16, 1999.

(60) Provisional application No. 60/093,849, filed on Jul. 22, 1998, provisional application No. 60/094,065, filed on Jul. 24, 1998, provisional application No. 60/094,073, filed on Jul. 24, 1998, provisional application No. 60/094,116, filed on Jul. 24, 1998, provisional application No. 60/094,120, filed on Jul. 24, 1998, provisional application No. 60/094,122, filed on Jul. 24, 1998, and provisional application No. 60/094,127, filed on Jul. 24, 1998.

(51) Int. Cl.[7] ..... G07B 17/00

(52) U.S. Cl. ..... 705/410; 705/60

(58) Field of Search ..... 705/60, 61, 62, 705/403, 404, 405, 410

(56) References Cited

U.S. PATENT DOCUMENTS 4,484,307 A * 11/1984 Quatse et al. ..... 705/410
4,657,697 A * 4/1987 Chaing ..... 252/301.35
4,725,718 A * 2/1988 Sansone et al. ..... 235/495
4,813,912 A * 3/1989 Chickneas et al. ..... 705/408
5,271,322 A * 12/1993 Palma ..... 101/333
5,280,531 A * 1/1994 Hunter ..... 705/404
5,625,694 A * 4/1997 Lee et al. ..... 705/60
5,638,442 A * 6/1997 Gargiulo et al. ..... 380/2
5,715,164 A * 2/1998 Liechti et al. ..... 705/410
5,822,738 A * 10/1998 Shah et al. ..... 705/410
5,920,850 A * 7/1999 Hunter et al. ..... 705/405
5,963,928 A * 10/1999 Lee ..... 705/401

FOREIGN PATENT DOCUMENTS

WO WO-00/49580 A1 * 8/2000

OTHER PUBLICATIONS

Barker–Benfield: "First Union Offers Online Transactions"; Florida Times–Union, Jan. 28, 1997.*

(List continued on next page.)

*Primary Examiner*—Edward R. Cosimano
(74) *Attorney, Agent, or Firm*—Townsend and Townsend and Crew

(57) ABSTRACT

A postage metering system includes a computer, a docking station, and a postage metering device. The computer includes an interface to receive postage information (i.e., from a user). The docking station couples to the computer, and the postage metering device operatively couples to the computer via the docking station (i.e., the postage metering device is removably coupled to the docking station). The postage metering device includes a secure metering device (SMD) that stores accounting information and, in some implementations, circuitry that performs secure processing. In some implementations, the postage metering device further includes a printer that couples to the SMD and prints indicia. In some implementations, the postage metering device is characterized at least by a "docked" operating mode and an "undocked" operating mode. The docked operating mode corresponds to the postage metering device being coupled to the computer, and the undocked operating mode corresponds to the postage metering device being uncoupled from the computer. Each operating mode is defined by a set of operating characteristics relating to, for example, funding of the metering device and printing of indicia.

21 Claims, 7 Drawing Sheets

OTHER PUBLICATIONS

"Information–Based Indica Program (IBIP), Performance Criteria for Information–Based Indicia and Security Architecture for Closed IBI Postage Metering Systems (PCIBI–C)" Jan. 12, 1999, United States Postal Service, dated Jan. 12, 1999.

"Information Based Indicia Program (IBIP) Indicium Specification," United States Postal Service, dated Jun. 13, 1996.

Information Based Indicia Program Postal Security Device Specification, United States Postal Service, dated Jun. 13, 1996.

"Information Based Indicia Program Host System Specification [Draft]," United States Postal Service, dated Oct. 9, 1996.

"Information–Based Indicia Program (IBIP), Performance Criteria for Information–Based Indicia and Security Architecture for IBI Postage Metering Systems (PCIBISAIBI-PMS)," United States Postal Service, dated Aug. 19, 1998.

United States Postal Service, "Performance Criteria For Information–Based Indicia And Security Architecture For Open IBI Postage Evidencing Systems," Information Based Indicia Program (IBIP), Jun. 25, 1999 XP–002161216.

* cited by examiner

METHOD AND APPARATUS FOR OPERATING A SECURE METERING DEVICE

This application claims priority from the following U.S. provisional and non-provisional applications, the disclosures of which, including software appendices and all attached documents, are incorporated by reference in their entirety for all purposes:

application Ser. No. 60/093,849, entitled "Method and Apparatus for Postage Label Authentication," filed Jul. 22, 1998, of J P Leon and David A. Coolidge;

application Ser. No. 60/094,065, entitled "Method and Apparatus for Resetting Postage Meter," filed Jul. 24, 1998, of J P Leon;

application Ser. No. 60/094,073, entitled "Method, Apparatus, and Code for Maintaining Secure Postage Information," filed Jul. 24, 1998, of J P Leon, Albert L. Pion, and Elizabeth A. Simon;

application Ser. No. 60/094,116, entitled "Method and Apparatus for Dockable Secure Metering Device," filed Jul. 24, 1998, of J P Leon;

application Ser. No. 60/094,120, entitled "Method and Apparatus for Remotely Printing Postage Indicia," filed Jul. 24, 1998, of Chandrakant J. Shah, J P Leon, and David A. Coolidge;

application Ser. No. 60/094,122, entitled "Postage Metering System Employing Positional Information," filed Jul. 24, 1998, of J P Leon;

application Ser. No. 60/094,127, entitled "Method and Apparatus for Operating a Removable Secure Metering Device," filed Jul. 24, 1998, of J P Leon;

application Ser. No. 09/250,990, entitled "Postage Meter System," filed and a continuation of Feb. 16, 1999, of J P Leon.

The following related patent applications filed on the same day herewith are hereby incorporated by reference in their entirety for all purposes:

U.S. patent application Ser. No. 09/358,801, entitled "Method and Apparatus for Postage Label Authentication," filed Jul. 21, 1999, of J. P. Leon;

U.S. patent application Ser. No. 09/358,802, entitled "Method, Apparatus, and Code for Maintaining Secure Postage Data," filed Jul. 21, 1999, of J. P. Leon, Albert L. Pion and Elizabeth A. Simon;

U.S. patent application Ser. No. 09/359,163, entitled "Postage Metering System Employing Positional Information," filed Jul. 21, 1999, of J. P. Leon;

U.S. patent application Ser. No. 09/359,162, entitled "Method and Apparatus for Resetting Postage Meter," filed Jul. 21, 1999, of J. P. Leon;

U.S. patent application Ser. No. 09/358,511, entitled "Method and Apparatus for Remotely Printing Postage Indicia," filed Jul. 21, 1999, of Chandrakant J. Shah, J. P. Leon and David A. Coolidge.

BACKGROUND OF THE INVENTION

The present invention relates generally to postage metering systems, and more particularly to a postage metering device that is secure and operable as a dockable or removable device.

Historically, postage meters have been dedicated, standalone devices capable only of printing postage indicia on envelopes or labels (in the case of parcels). These meters typically reside at a single user location and provide postage metering for that location alone. Such meters conventionally require the user to physically transport the device to a post office for "resetting" to increase the amount of credit registered in the meter.

An advance over these meters is the ability to allow the user to reset the meter via codes, provided by either the manufacturer or the postal authority, once payment has been made by the user. Modern electronic meters are often capable of being reset directly by an authorized party, on-site at the user's location via a communications link. One such system that performs meter resetting in this manner is known as a Computerized Meter Resetting System (CMRS). The party having authority to reset the meter and charge the customer (usually the manufacturer or the postal authority) gains access to and resets the meter.

Even with remote resetting, postage meters are still, for the most part, limited to use at a single physical location. As such devices are typically dedicated and also sophisticated in their fail-safe attributes and security, their price tends to be prohibitive for small entities. Moreover, because of the meter's physical size and the need for supporting connections (power, communications, and the like), it is often necessary to bring the items requiring postage to the meter.

As can be seen, what is needed is a postage metering, system that is portable, low-cost, and flexible in operation, while maintaining the security features normally associated with a secure postage metering system.

SUMMARY OF THE INVENTION

The invention provides a postage metering system that is portable, low-cost, secure, and flexible in operation. By careful partitioning of the various features and functions of the metering system, a modular, compact, and low-cost design can be achieved. The postage metering system includes one or more postage metering devices that removably couples to a computer (or host PC) via a direct connection or a docking station. The host PC provides the user interface and coordinates transactions between the metering device and a postal provider. In some embodiments, multiple postage metering devices operate from, and share, one docking station.

Each postage metering device includes facilities to store important postal (i.e., accounting) information, perform secure processing, print postage indicia, and perform various other transactions such as funding of the metering device. Each of these functions can be achieved by a module that may be removable from, or affixed to the metering device. A secure metering device (SMD) maintains important postal information and, in some embodiments, performs secure processing to provide centralized postage accounting and security functions. The SMD can be housed in a smartcard or other small-size and removable units. A small dedicated printer for printing indicia enhances portability and decreases cost. The printer may also be removable from, or affixed to the metering device. The modular and compact postal metering system allows for printing of postage indicia at locations that are convenient to the end-user by allowing the user to take a portion of the system to the items requiring postage, rather than the reverse.

An embodiment of the invention provides a postage metering system that includes a computer, a docking station, and a postage metering device. The computer includes an interface to receive postage information (i.e., from a user). The docking station couples to the computer, and the postage metering device operatively couples to the computer via the docking station (i.e., the postage metering device is removably coupled to the docking station). The postage metering device includes a secure metering device (SMD) that stores accounting information and, in some implementations, circuitry that performs secure processing. In some implementations, the postage metering device further includes a printer that couples to the SMD and prints indicia.

In some implementations, the postage metering device is characterized by at least a "docked" operating mode and an "undocked" operating mode. The docked operating mode corresponds to the postage metering device being coupled to the computer, and the undocked operating mode corresponds to the postage metering device being uncoupled from the computer. Each operating mode is defined by a set of operating characteristics relating to, for example, funding of the metering device and printing of indicia.

Another embodiment of the invention provides a postage metering system that includes a computer and a number of postage metering devices. The computer includes an input interface to receive postage information. Each postage metering device includes first and second interface ports and a secure metering device (SMD) that stores accounting information. Each postage metering device couples to at least one external device via the interface ports. The external device can be the computer or other postage metering device. Funding of a particular postage metering device is performed when that device is coupled to the external device.

Yet another embodiment of the invention provides a postage metering device that includes an interface port, a secure metering device (SMD), a printer, and an enclosure that houses the interface port and the printer. The SMD removably couples to the interface port of the metering device and includes a memory element, a processor, and an enclosure that houses the memory element and the processor. The memory element stores accounting information. The processor operatively couples to the memory element, receives a message, processes the message to generate an inidicium, and updates the accounting information to account for the generated indicium. The printer couples to the SMD and prints the received indicium.

The foregoing, together with other aspects of this invention, will become more apparent when referring to the following specification, claims, and accompanying drawings.

DESCRIPTION OF THE SPECIFIC EMBODIMENTS

Figure 1:
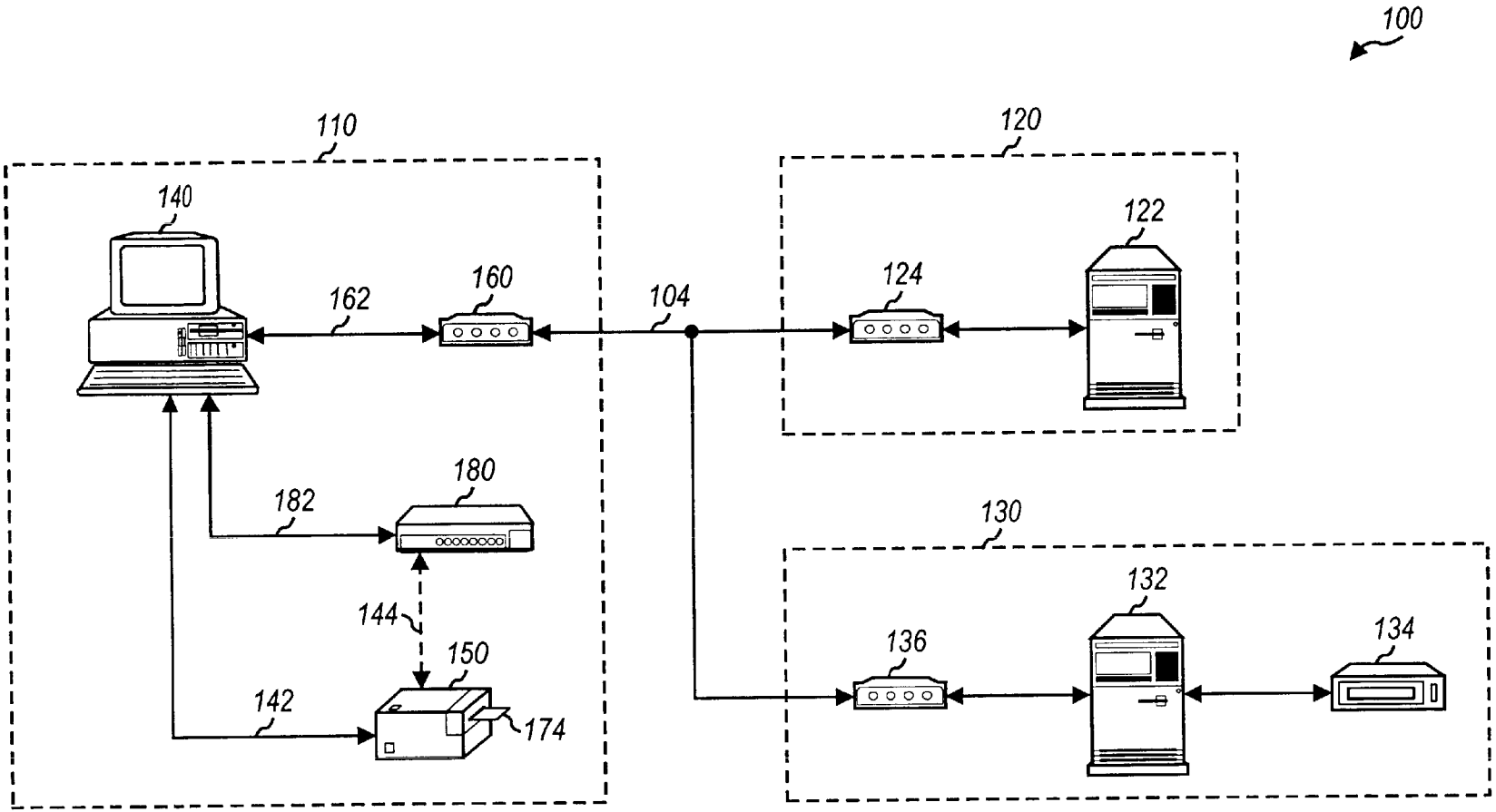
FIG. 1 shows a diagram of an embodiment of a postal system in accordance with the invention.

FIG. 1 shows a diagram of an embodiment of a postal system 100 in accordance with the invention. Postal system 100 includes a postage metering system 110, a central processing system 120, and a postal information system 130. The three systems communicate via a communications link 104, which can be a wireline link (e.g., telephone, Internet, cable, and others) or a wireless link (e.g., cellular, terrestrial, satellite, RF, infrared, microwave, and other links).

Central processing system 120 includes a system server 122 that communicates, via a communications device 124, with other systems coupled to communications link 104. In a specific implementation, central processing system 120 is referred to as a Postage-On-Call™ system or POC system. The operation of central processing system 120 is the subject of government standards and not described in detail herein. The interaction between central processing system 120 with postage metering system 110 is discussed below, as necessary for the understanding of the invention.

Postal information system 130 is a commercially available system, with approximately 150 or more installations in the United States, that provides access to national (and possibly international) postal information such as ZIP codes, rate tables, and other information. Postal information system 130 includes a system server 132 that communicates, via a communications device 136, with other systems coupled to communications link 104. System server 132 further couples to a storage unit 134 that stores a database of postal information (such as national and international postal ZIP code information). Storage unit 134 can be implemented with a CD-ROM device, a tape drive, a hard disk, other mass storage devices, or a combination of these devices. The operation of postal information system 130 is not described in detail herein.

Postage metering system 110 performs the functions associated with conventional postage meters and may include a general-purpose computer 140 (also referred to as a host PC), a postage metering device 150, and an (optional) electronic scale 180. In some embodiments, metering device 150 is implemented as a dockable or removable device, or both. Metering device 150 directs the printing of postage indicia and performs accounting functions generally associated with postage meters. In an embodiment, metering device 150 generates postage indicia for printing by a printer onto mailpieces, as exemplified by a label 174.

As shown in FIG. 1, postage metering device 150 couples to host PC 140 via a communications link 142, which can be a wireline or wireless, and secure or unsecured link. For example, communications link 142 can be a standard serial or parallel interface and may employ any mechanism for transferring information, such as an RS-232C serial communications link. To provide a secure communications link that resists unauthorized interception, data can be encrypted, encoded, or signed before being sent over the communications link.

In the embodiment shown in FIG. 1, postage metering device 150 includes a built-in printer (not shown). This printer facilitates the printing of postage indicia on labels and envelopes (exemplified by indicium label 174). Optional electronic scale 180 may be coupled to either host PC 140 via a communications link 182 or to metering device 150 via a communications link 144. A communications device 160 (e.g., a modem, transceiver, or others) may also be coupled to host PC 140 via a communications ink 162 (e.g., an RS-232C serial communications link). Communications device 160 provides access to central processing system 120 and postal information system 130 via communications link 104. Host PC 140 and metering device 150 communicate postage information (e.g., registration, funding, or auditing information) with system server 122. Optionally, host PC 140 and metering device 150 may communicate with system server 132 (i.e., to obtain ZIP code and other information).

Figure 2:
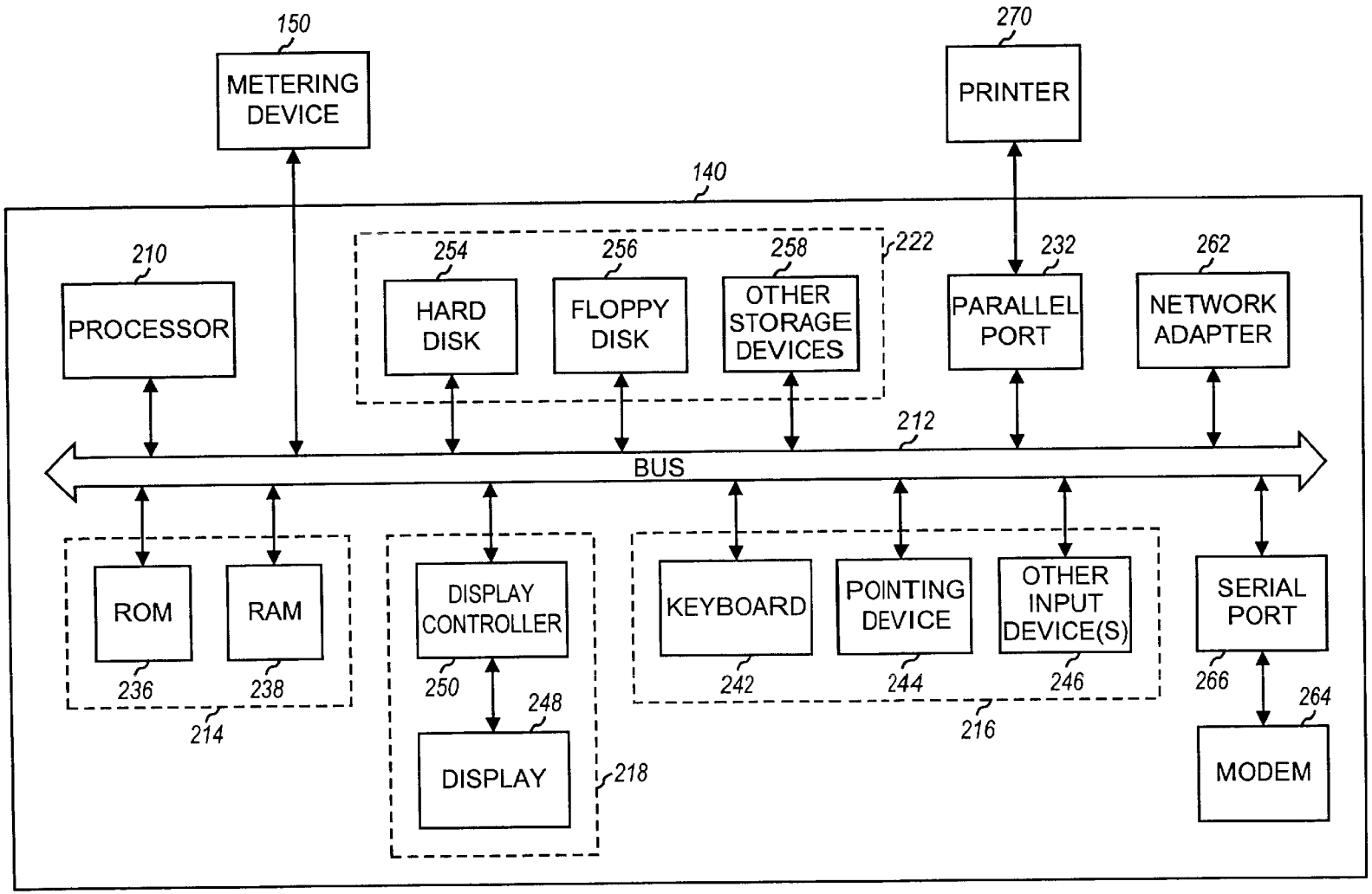
FIG. 2 shows a block diagram of an embodiment of a host PC.

FIG. 2 shows a block diagram of an embodiment of host PC 140. Host PC 140 may be a desktop general-purpose computer system, a portable system, a simplified computer system designed for the specific application described herein, a server, a workstation, a mini-computer, a larger mainframe system, or other computing systems.

As shown in FIG. 2, host PC 140 includes a processor 210 that communicates with a number of peripheral devices via a bus 212. These peripheral devices typically include a memory subsystem 214, a user input subsystem 216, a display subsystem 218, a file storage system 222, and output devices such as a printer 270. Memory subsystem 214 may include a number of memory units, including a non-volatile memory 236 (designated as a ROM) and a volatile memory 238 (designated as a RAM) in which instructions and data may be stored. User input subsystem 216 typically includes a keyboard 242 and may further include a pointing device 244 (e.g., a mouse, trackball, or the like) and/or other common input device(s) 246. Display subsystem 218 typically includes a display device 248 (e.g., a cathode ray tube (CRT), a liquid crystal display (LCD), or other devices) coupled to a display controller 250. File storage system 222 may include a hard disk 254, a floppy disk 256, other storage devices 258 (such as a CD-ROM drive, a tape drive, or others), or a combination thereof.

Host PC 140 includes a number of interface devices that facilitate communication with external devices. For example, a parallel port 232 interfaces with printer 270. Network connections are usually established via a device such as a network adapter 262 coupled to bus 212, or a modem 264 via a serial port 266. Other interfaces (e.g., serial ports, infrared and wireless devices, and others) can be provided to interface with, for example, metering device 150 and scale 180.

As used herein, the term "bus" generically refers to any mechanism for allowing various elements of the system to communicate with each other. Bus 212 is shown as a single bus but may include a number of buses. For example, a system typically has a number of buses including a local bus and one or more expansion buses (e.g., ADB, SCSI, ISA, EISA, MCA, NuBus, or PCI), as well as serial and parallel ports.

With the exception of the input devices and the display, the other elements need not be located at the same physical site. For example, portions of the file storage system could be coupled via various local-area or wide-area network links, including telephone lines. Similarly, the input devices and display need not be located at the same site as the processor, although it is anticipated that the present invention will likely be implemented in the context of general-purpose computers and workstations.

Figure 3A:
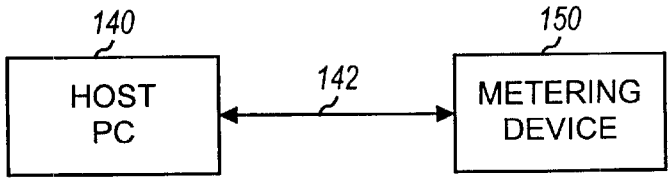
FIGS. 3A through 3D show diagrams of various embodiments of the postal metering system of the invention.
Figure 3B:
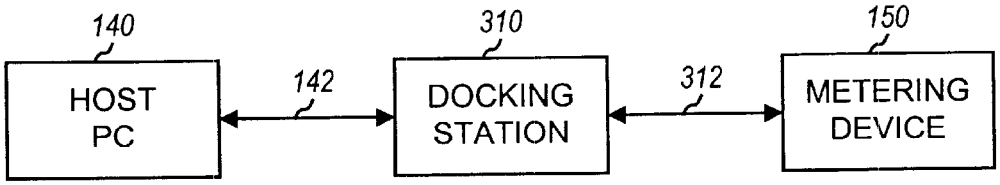

FIGS. 3A through 3D show diagrams of various embodiments of the postal metering system of the invention. FIG. 3A shows metering device 150 coupled to host PC 140 via communications link 142. This embodiment is also shown in FIG. 1. FIG. 3B shows metering device 150 coupled to host PC 140 via a docking station 310. Docking station 310 couples to host PC 140 via communications link 142 and to metering device 150 via a communications link 312. The implementation of docking station 310 is described in detail below.

Figure 3C:
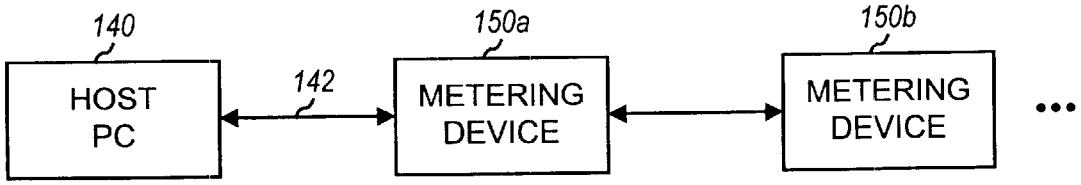

FIG. 3C shows multiple postage metering devices 150*a*, 150*b*, and so on, coupled in series and to host PC 140. This embodiment allows one host PC 140 to service multiple metering devices 150. Metering devices 150 can also be coupled in parallel (i.e., via multiple ports) to host PC 140. Metering devices 150 can also be coupled in a star configuration, with multiple metering devices 150 coupled to a particular metering device that may further couple to another metering device. Various other configurations that allow for interconnection of multiple metering devices 150 are also possible and are within the scope of the invention. In some multiple metering device embodiments, one metering device can be designated as a master metering device and the remaining metering devices can be designated as satellite devices, as described below.

The present invention is not limited by any one placement, interconnection, of configuration of the postage metering device(s) in the postage metering system. There may be one or many metering devices, each storing postage information for any number of user sites. Such sites may be local, or remote and widely dispersed geographically.

Figure 3D:
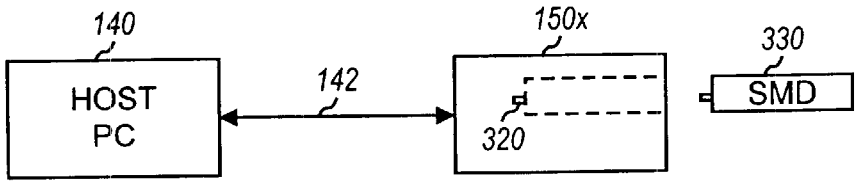

FIG. 3D shows a postage metering device 150*x* coupled to host PC 140 via communications link 142. Metering device 150*x* includes an interface 320 for receiving a secure metering device (SMD) 330. In a specific embodiment, SMD 330 includes accounting information, security sensitive data, and secure circuitry, as described below. In a specific embodiment, SMD 330 is implemented as a portable and removable unit, such as a smartcard, a cartridge, a module, or other small-size units. Of course, metering device 150*x* can be coupled to host PC 140 via docking station 310.

In an embodiment, docking station 310 is implemented as a unit separable from host PC 140 and postage metering device 150. This allows docking station 310 to be moved from location to location, as needed and wherever a host PC is available. In another embodiment, docking station 310 is housed within host PC 140 and communicates directly with bus 212 (see FIG. 2).

Figure 4A:
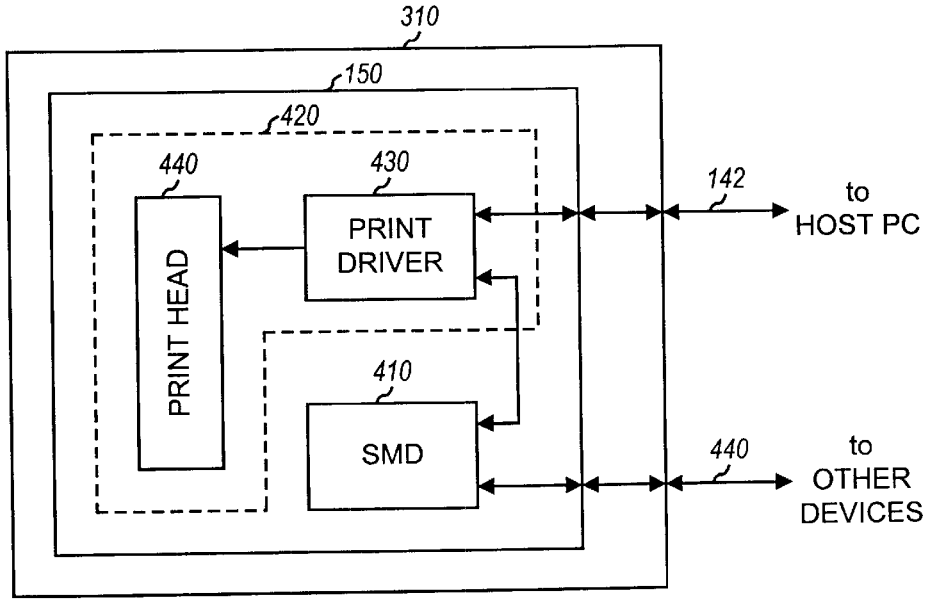
FIG. 4A shows a diagram of an embodiment of a postage metering device and a docking station.

FIG. 4A shows a diagram of an embodiment of postage metering device 150 and docking station 310. In an embodiment, metering device 150 is housed is an enclosure separate from that of host PC 140. The enclosure is typically a secure housing to prevent, discourage, and disclose tampering by unauthorized persons. In the embodiment shown in FIG. 4A, metering device 150 includes SMD 410 coupled to a printer 420. SMD 410 can be a removable unit, such as SMD 330 shown in FIG. 3D. Printer 420 includes a print driver 430 coupled to a print head 440 that imprints postage indicium. Print driver 430 couples to host PC 140 via communications link 142 and to SMD 410. SMD 410 can further couple to other device(s), such as scale 180 or another metering device 150, via a communications link 440. As shown in FIG. 4A, docking station 310 acts as a conduit to allow metering device 150 to couple to host PC 140 and other external devices.

In the embodiment shown in FIG. 4A, the printer is enclosed within the postage metering device. The printer interface (i.e., to and from the printer) can be designed to operate on a command set written to reject external print commands, as described in the aforementioned U.S. patent application Ser. No. 09/250,990.

Figure 4B:
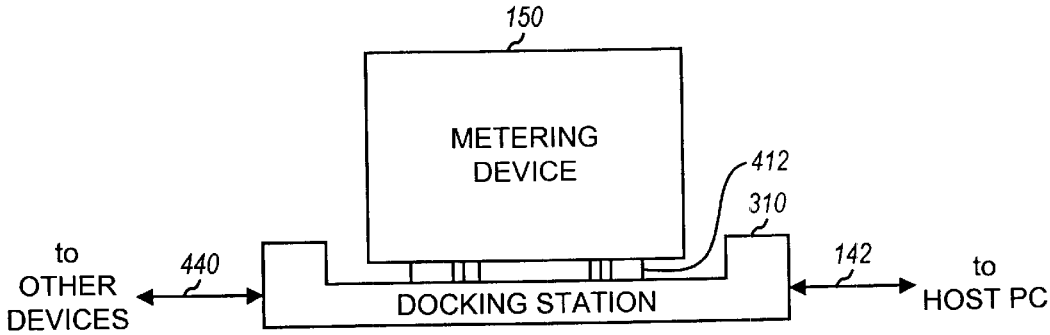
FIG. 4B shows a diagram of an implementation of the postage metering device and the docking station.

FIG. 4B shows a diagram of an implementation of postage metering device 150 and docking station 310. As shown in FIG. 4B, metering device 150 includes one or more connectors 412 that interconnect to a corresponding set of connectors located on docking station 310. These connectors can be, for example, D-SUB connectors, printed circuit card edge connector, and others. Docking station 310 may also include interfaces that couple to the host PC via communications link 142 and to another device (e.g., another metering device 150 or scale 180) via communications link 440. Using docking station 310, metering device 150 can be quickly, easily, and conveniently coupled to the host PC.

Figure 4C:
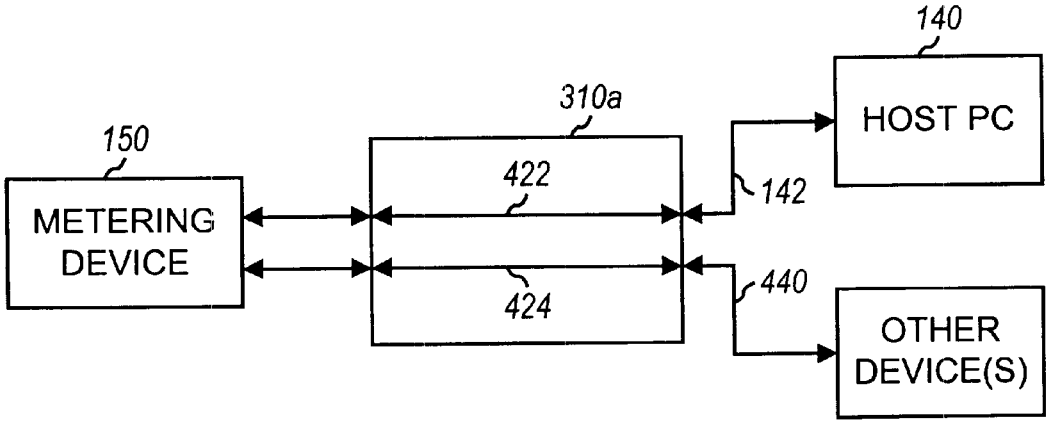
FIGS. 4C and 4D show diagrams of two embodiments of the docking station.

FIG. 4C shows a diagram of an embodiment of a docking station 310*a*. Docking station 310*a* includes a set of interconnects 422 and 424 that interface to communications links 142 and 440, respectively. In this embodiment, interconnects 422 and 424 are implemented using passive components and include no active components. Interconnects 422 and 424 can be implemented, for example, as etched lines on a printed circuit board, electrical wires, or a combination thereof.

Figure 4D:
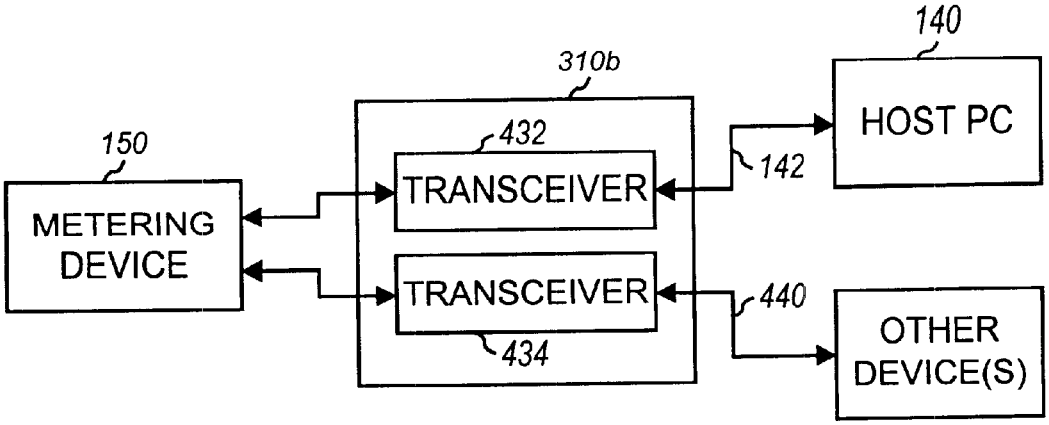

FIG. 4D shows a diagram of an embodiment of another docking station 310*b*. Docking station 310*b* includes a set of interconnects 432 and 434 that interfaces to communications links 142 and 440, respectively. In this embodiment, the interconnects are implemented using passive and active components. The active components can include a buffer, a transceiver, or others, to provide signal buffering, signal conditioning, level translation (i.e., TTL levels to RS-232 levels), and other functions. For example, the signal levels from postage metering device 150 can be TTL and the signal levels from host PC 140 can be RS-232. As shown in the embodiment in FIG. 4D, each interconnect includes a bi-directional transceiver that receives and conditions the input signals and provides translation of signal levels (e.g., TTL to RS-232, or vice versa, or both), as necessary.

Figure 5:
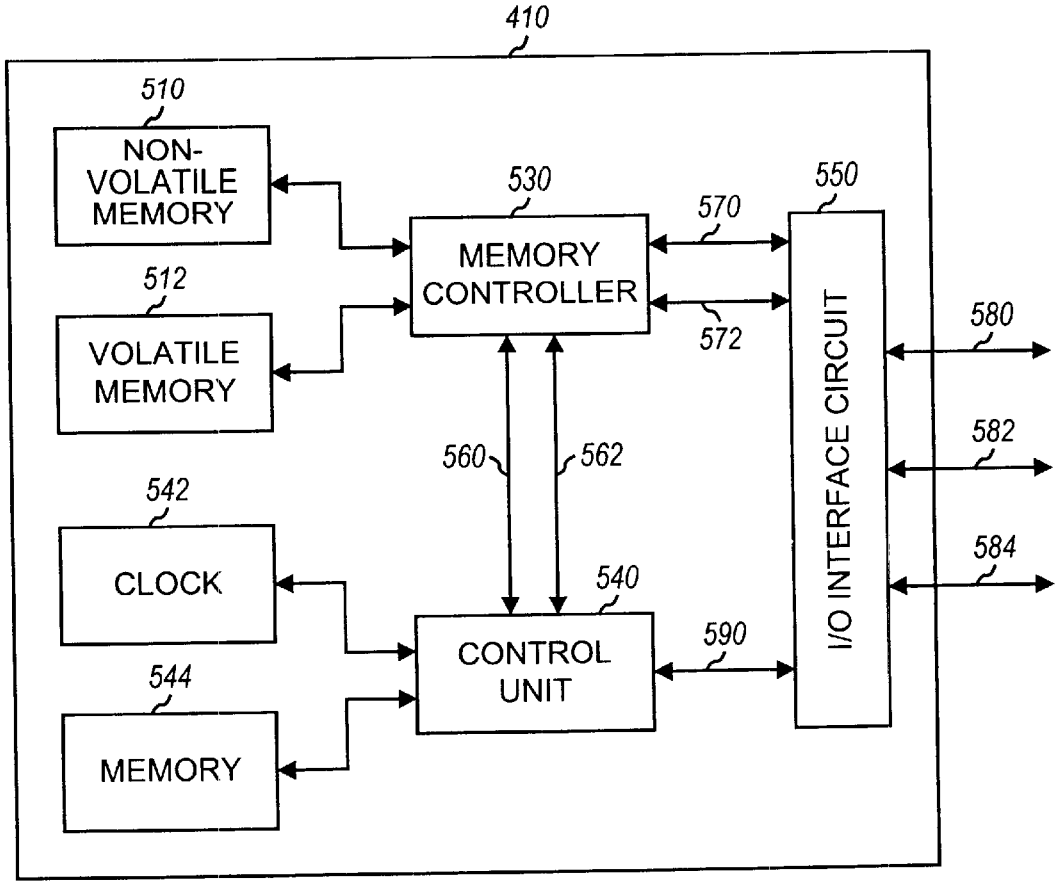
FIG. 5 shows a block diagram of an embodiment of a secure metering device (SMD).

FIG. 5 shows a block diagram of an embodiment of SMD 410. A non-volatile memory 510 and a volatile memory 512 receive data from, and provide data to, a memory controller 530. Memories 510 and 512 provide storage of accounting information, program codes, and other data. In an embodiment, some of the accounting information is stored in an ascending register, a descending register, and a control total register (none of which is shown in FIG. 5). The ascending register holds a value indicative of the amount of postage used, the descending register holds a value indicative of the amount of postage that remains unused (i.e., the available funds), and the control total register holds the sum of the values in the ascending and descending registers.

Memory controller 530 may be accessed by a control unit 540 and an input/output (I/O) interface circuit 550. Control unit 540 accesses memories 510 and 512 by reading or writing on data lines 560, and controls these operations via control lines 562. I/O interface circuit 550 accesses memories 510 and 512 by reading or writing data on data lines 570, and controls these operations via control lines 572.

As shown in FIG. 5, I/O interface circuit 550 further couples to a service port 580, an I/O port 582, and a printer port 584. Service port 580 allows access (e.g., with proper access codes) to memories 510 and 512 (e.g., for diagnostic, repair, and maintenance of metering device 150). I/O port 582 supports communications with a general-purpose computer, such as host PC 140 in FIG. 1, via communications link 142. Printer port 584 supports communications with a printer, such as printer 420 in FIG. 4A. Printer 420 supports the printing of postage indicia directly from the postage metering device.

Control unit 540 communicates with service port 580, I/O port 582, and printer port 584 via control and data lines 590 and I/O interface circuit 550. Control unit 540 includes circuitry for controlling the functions of SMD 410, and may couple to a clock 542, a memory 544, and other circuitry (not shown in FIG. 5) that supports the operation of control unit 540. The secure processing (e.g., encryption, encoding, digital signature generation, and other functions) may be performed by a sub-unit of control unit 540, such as a hardware security processor (not shown). Alternatively, the secure processing may be performed by a software algorithm resident in memory 544 and executed by control unit 540. Such software algorithm can include, for example, the DES or RSA algorithm for encryption, the DSA and elliptical curve algorithm for digital signature generation, and other algorithms.

The SMD architecture shown in FIG. 5 resembles, to an extent, the architecture disclosed in U.S. Pat. No. 4,484,307 issued Quatse et al. and incorporated herein by reference. Another SMD architecture is disclosed in the aforementioned U.S. patent application Ser. No. 09/250,990. Other SMD architectures can be designed and are within the scope of the invention.

Processor 210 and control unit 540 can each be implemented as an application specific integrated circuit (ASIC), a digital signal processor, a controller, a microcontroller, a microprocessor, or other electronic units designed to perform the functions described herein. Non-volatile memories 236 and 510 can each be implemented as a read only memory (ROM), a FLASH memory, a programmable ROM (PROM), an erasable PROM (EPROM), an electronically erasable PROM (EEPROM), a battery augmented memory (BAM), a battery backed-up RAM (BBRAM), or devices of other memory technologies. Volatile memory 238 and 512 can each be implemented as a random access memory (RAM), a dynamic RAM (DRAM), a FLASH memory, or devices of other memory technologies.

Software codes to execute various aspects of the invention are located throughout the postal system (i.e., within host PC 140 and postage metering device 150). For example, software codes resident on host PC 140 enables the host PC to communicate with system server 122, metering device 150, and (optional) electronic scale 180. A protocol that supports communication between host PC 140 and system server 122 is disclosed in the aforementioned U.S. patent application Ser. No. 09/250,990. Software codes for performing the postage accounting functions of metering device 150 and SMD 410 can be similar to that disclosed in the aforementioned U.S. patent application Ser. No. 09/250,990 and U.S. Pat. No. 4,484,307.

In an embodiment, communication between host PC 140 and postage metering device 150 is bi-directional. Host PC 140 sends commands and requests to metering device 150. Metering device 150, in response, may send human-readable data (i.e., in response to requests for information), encrypted data, or both. In an embodiment, metering device 150 communicates with host PC 140 in the manner described in the aforementioned U.S. patent application Ser. No. 09/250,990.

Postage metering device 150 may operate in one of at least two operating modes. The first operating mode is a computer-interfaced (or "docked") operating mode in which metering device 150 is coupled to host PC 140 via communications link 142. The second operating mode is a stand-alone mode in which metering device 150 is configured to print postage indicia of a particular value. As described below and in the aforementioned U.S. patent application Ser. No. 09/250,990, the stand-alone mode is supported in embodiments in which metering device 150 includes revenue registers, an input mechanism, and possibly a label printer.

In the docked operating mode, postage metering device 150 couples to host PC 140 and responds to commands and requests from the host PC. In this mode, metering device 150 can print indicia of any desired value, subject to a set of conditions. For example, postage can be requested by entering postage information into host PC 140 and initiating a request to print an indicium. Host PC 140 sends this information, together with additional information as appropriate or required (e.g., the mail class/service, destination ZIP-code, and other required values such as insurance) in a request message to metering device 150. In an embodiment, failure in the transmission of this message prevents issuance of postage by metering device 150. Metering device 150 receives the information in the request message and constructs a postage indicium print file that may include, for example, information such as a two-dimensional code, graphical information, human-readable data, or a combination of the above. The postage indicia print file, together with optional information (such as address information, ZIP-code, barcode, and any user-defined information) is transmitted to the printer (e.g., printer 420) for printing. Metering device 150 thus responds to the indicium printing request by generating a secure (e.g., using encryption, digital signature, or other mechanisms) postage indicium.

In the undocked operating mode, postage metering device 150 is uncoupled or undocked from host PC 140, and is portable. Before entering this mode, metering device 150 is funded with a particular amount of funds and is then undocked from host PC 140. Metering device 150 can then be moved to various locations convenient to the user for printing postage indicia. In this mode, metering device 150 acts as a highly portable postage meter capable of being easily moved to the location of large parcels and the like, thereby obviating the need to move such large packages to the meter. To support the undocked mode, metering device 150 includes an input mechanism for receiving a user request. The input mechanism can be implemented, for example, with a keyboard, a touchpad, a switch, a button, other data entry mechanisms that allow for entry of command or data, or a combination of these devices.

In a specific implementation, postage metering device 150 is configured to print indicia having a particular value while operating in the undocked mode. In this implementation, the user initially loads the metering device with funds and sets the particular value via the host PC. After the loading the funds, metering device 150 is undocked and functions as a self-contained portable postage meter capable of printing indicia having a default value. For this implementation, a single key input can be used to direct metering device 150 to print an indicium. In the stand-alone mode, metering device 150 is capable of printing as many indicia (i.e., of the default value) as allowed by the funds stored in the metering device. Once metering device 150 has expended the funds stored therein, it is re-docked with host PC 140 to load additional funds in the revenue registers. In a similar manner, the user can re-dock metering device 150 and reconfigures it using the host PC (i.e., to change the default value).

Figure 6:
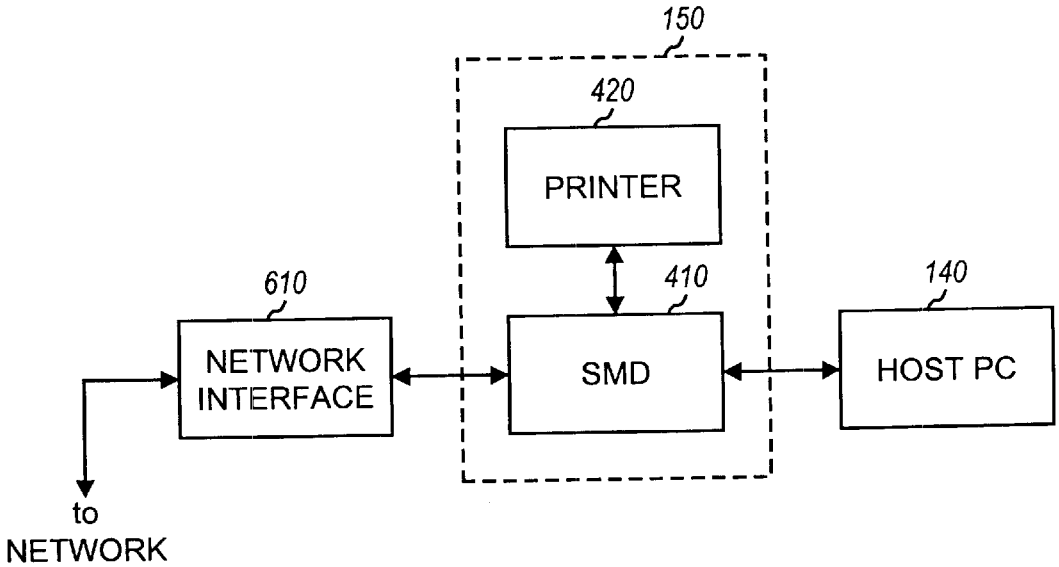
FIG. 6 shows a block diagram of an embodiment of a configuration that allows for remote transactions by the postage metering device over a network.

FIG. 6 shows a block diagram of an embodiment of a configuration that allows for remote transactions by (i.e., funding of) postage metering device 150 over a network. As shown in FIG. 6, metering device 150 couples to a network via a network interface 610. Network interface 610 can be a telephone modem, a cable modem, a wireless modem, a terrestrial modem, a microwave modem, a satellite modem, and others. Although shown as a separate unit in FIG. 6, network interface 610 can be built into metering device 150. The network can be a local area network (LAN), a wide area network (WAN), the Internet, or other networks. This configuration allows a user to reset the metering device from any location at which a network connection can be established.

Postage metering device 150 may include accounting information for a single account (i.e., an entire organization may be represented by a single account) or may include accounting information for a single department within the organization. Typically, the accounting information contained in metering device 150 pertains only to personnel or department(s) authorized for using the device, and so allows for accounting by any organizational construct. Metering device 150 may also include other pertinent information, such as codes indicative of authorized users. Metering device 150 can provide site-specific accounting information to the a central accounting facility and also to the site accounting facility.

Referring back to FIG. 1, host PC 140 couples to communications link 104 via communications device 160 and communicates with system server 122 for various transactions. These transactions include: (1) registration, funding, and withdrawal of postage metering device 150, (2) auditing by postal authorities, (3) reporting of detected faults, and others. For example, host PC 140 communicates with system server 122 to remotely reset metering device 150 (i.e., to add postage credit to the value currently stored in metering device 150). Other functions and transactions may be achieved remotely in a similar manner. The various transactions are further described in the aforementioned U.S. patent application Ser. No. 09/250,990.

The invention further provides techniques for operating multiple postage metering devices that may have similar or different hardware and software configurations. Some embodiments are described below.

In an embodiment for operating multiple postage metering devices, one postage metering device 150 is designated as a "master" unit and the remaining postage metering devices 150 are designated as "satellite" units. The satellite units can be conceptually similar to the master unit. In an embodiment, the satellites and master units have different software configurations, but may or may not differ in their hardware. Alternatively, a host PC (or other systems or devices) that includes a SMD may implement the master unit.

In an embodiment, the master unit interfaces to the host PC and functions like a conventional postage meter. The master unit includes the typical revenue registers (e.g., ascending register, descending register, and control total register), and is loaded with funds using any meter resetting method (e.g. remotely through a Postage-on-Call or POC system). The master unit can be licensed and tracked by the manufacturer or the postal authorities, or both, in the normal manner. The master unit can also include mechanism for imprinting postage indicia.

In an embodiment, the satellite unit(s) communicate with the master unit for various transactions, such as the downloading of a portion of the funds stored in the revenue registers of the master meter. The downloaded funds are stored in the revenue registers of the satellite unit. Afterwards, the satellite unit can operate without connection to the master unit or the host PC, and can be portable. The satellite unit may be configured to respond only to a designated master unit. Alternatively, the satellite unit may be configured to respond to a set of more than one designated master units (i.e., including the host PC).

The satellite unit may be implemented using various architectures. For example, the satellite unit may include a (built-in or plugged-in) user-interface to make the unit user-friendly. The user-interface can be a fill keyboard that allows for selection and printing of indicia having any postage value, up to a preset maximum value. Alternatively, the user-interface can be a simplified set of one or more switches or buttons that allow for printing of indicia having a predetermined (default) postage value. This simplified user interface may by a single "Print" key. The default value can be changed by docking the satellite unit to a host PC and using the keyboard on the host PC to enter and set the new default value. The default value can also be changed by coupling to the master unit and using the interface facilities of the master unit. Thus, in some implementations, the satellite meter does not have to be coupled to the master meter to set the default value.

The satellite unit may or may not include a (built-in or removable) printer. In some architectures, the complete satellite unit may be inseparable, and again can include a printer.

In an embodiment, the satellite unit can also interface directly (or indirectly via other units) to a general-purpose computer (GPC), and can print indicia having any selected postage value entered via the keyboard on the GPC. Communication with the GPC may or may not be secure. The GPC may be, but does not need to be, the same computer as the host PC used to interface with the master unit.

In an embodiment, the master unit is capable of holding a (relatively) large amount of funds, which could then be downloaded in smaller increments to satellite units. The satellite units can then be undocked and used to print indicia without fear of losing large amounts of funds, should one or more satellite units be lost or stolen.

In another embodiment for operating multiple postage metering devices, one SMD 410 is designated as a master SMD and the remaining SMDs 410 are designated as satellite SMDs. In this embodiment, the SMD may be enclosed in a smartcard, a cartridge, or other small-size modules, and includes the revenue registers. Depending on the particular implementation, the SMD may also include circuitry that performs securing processing (i.e., encryption, digital signature, and so on). Generally, the revenue registers of the SMD are protected such that unauthorized loading of additional funds and unauthorized modification of values in the revenue registers are prohibited.

As shown in FIG. 3D, the SMD can be easily and conveniently inserted into any metering device 150*x*. The user can carry the SMD around, insert it into any convenient metering device for use, and remove the SMD after use. With each use, the revenue registers of the SMD are debited accordingly. Metering device 150*x* may also be portable, or located as a fixed location within a facility.

In yet another embodiment for operating multiple postage metering devices, the satellite SMDs are implemented using smartcards (or magnetic cards such as credit cards) and include mechanisms for storing accounting information. The smartcards can be inserted into any, or a set of designated, metering devices for funding and to print postage indicium. The accounting information can be accessed using a secure communication (i.e., via encryption or digital signature). The secure processing is performed by circuitry within the metering device to which the smartcard is inserted. In an embodiment, for each secure transaction, the accounting information is retrieved from the smartcard, decrypted or authenticated, and processed by the metering device. The updated accounting information is then encrypted or signed and written back to the smartcard. The smartcard can be recharged with additional funds by insertion into a metering device or host PC having such authority. Alternatively, the smartcard can be disposable when the funds are used up.

The postage metering system and postage metering device of the invention include many features and provide many advantages. Conventional postage meters can normally hold very large sums of funds (e.g., $99,999.99) and must be carefully controlled by the user to prevent loss due to misappropriation of postage, malicious misuse, or errors by inexperienced operators. If the meter is misused, or is stolen and not recovered, the amount of funds held in the meter can be irrecoverably lost to the user.

First, in accordance with an aspect of the invention, the satellite units can be quickly and easily funded in small increments. For many applications, values less than $25.00, for example, are still very useful. Loading small amounts into a conventional meter is theoretically possible, but usually impractical because of the time and expense involved to perform a loading of funds. Moreover, frequent funding transactions are typically discouraged by the postal authorities and meter manufacturers. The overhead costs for funding transactions are typically fixed regardless of the funding amount, and the overhead costs for small funding amounts can be prohibitive. With the convenient and cost effective funding mechanism of the invention, small amounts of funds can be easily downloaded into the satellite units at any time and with minimal cost.

The effective funding mechanism of the invention also limits the metering device lessor's liability. Unlike a conventional meter, the metering device of the invention can be funded as often as necessary (i.e., several times a day, or more). The funding transaction is also performed at the user's premise via the user's host PC. This feature reduces the need for the user to control the meter (i.e., for fear of loss or abuse of the funds) and increases the flexibility of use. As some examples, the mailrooms of a business can check out the metering devices to department secretaries, schools can allow student monitors to operate the metering devices, organizations can turn the metering devices over to unskilled volunteers, and so on.

Second, the funds are protected by secure processing of data transferred into or out of the metering device (or more specifically, the SMD). The secure processing can be achieved with the use of digital signatures or encryption, or both. The secure processing, coupled with physical security devices, for example FIPS security methods, ensure that the software or hardware cannot be easily tampered or modified to print unpaid postage. In addition, the metering device can be programmed to "go to sleep" after a period of non-use, forcing the user to reconnect it to the host PC before resuming operation, and thus increasing the difficulty of using a stolen metering device. The metering device can also be required to periodically perform audit transactions, as described in the aforementioned U.S. patent application Ser. No. 09/250,990.

Third, as noted above, the metering device's portability allows substantial flexibility in use. For example, in a warehouse it may be advantageous to move the metering device around and place postage on parcels instead of moving the parcels past a metering station. In a business, the metering device can be taken to locations where mail is prepared, reducing processing activity in the mailroom.

Fourth, the software and hardware used to implement the invention are (relatively) inexpensive in comparison to the costs of conventional postage metering systems. This allows the postage metering system or metering device of the invention to be dedicated to an individual user or a small group of users.

Fifth, in comparison to conventional postage meters, the use of the postage metering device is simplified. The individual user or site needs not maintain logbooks, lease equipment, comply with special regulations, physically transport a postage metering device to a post office for inspection, nor perform other custodial tasks normally related to the use of conventional postage meters.

Figure 7:
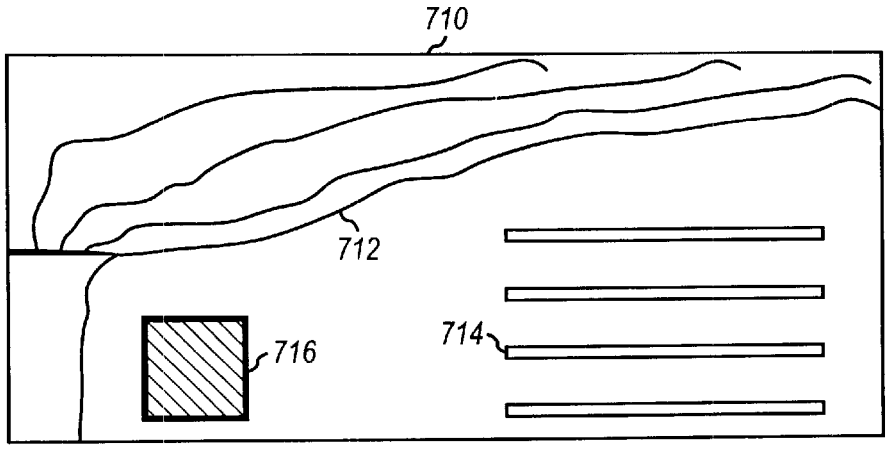
FIG. 7 shows a diagram of an embodiment of a postage indicium.

FIG. 7 shows a diagram of an embodiment of a postage indicium 710. Printer 420 is configured to imprint the postage indicium (and, optionally, other information) onto a label, a mailpiece, or other means of affixation of postage. Postage indicium 710 may include such features as a graphic 712, human-readable postage information 714, and encoded postage information 716. Encoded postage information 716 may be included inside or outside postage indicium 710, or omitted entirely.

A secure means of authenticating postage indicia is of great importance to the United States Post Office, which loses millions (and potentially billions) of dollars a year to the use of fraudulent postage indicia. In the preceding embodiments, the printer imprints a postage indicium and other information on a mailpiece. As shown in FIG. 7, postage indicium 710 may include human-readable postage information 714 and encoded postage information 716. These can be used to determine the authenticity of the affixed mark.

In an embodiment, information from postage metering device 150 (and, optionally, from host PC 140) may be signed by metering device 150 using a digital signature algorithm (e.g., DSS or a comparable algorithm). Alternatively, the information from metering device 150 may be encrypted using an encryption algorithm (e.g., DES, RSA, or a comparable algorithm). The information is then converted into a printable binary code. Examples of a printable binary code include bar codes, data matrix, PDF-417, and other comparable formats. The data matrix format allows for printing a relatively large amount of data in a small physical space. The data matrix format may be particularly advantageous for some applications such as postage on envelopes, labels, and the like, which generally requires minimal consumption of the available printing area.

Figure 8:
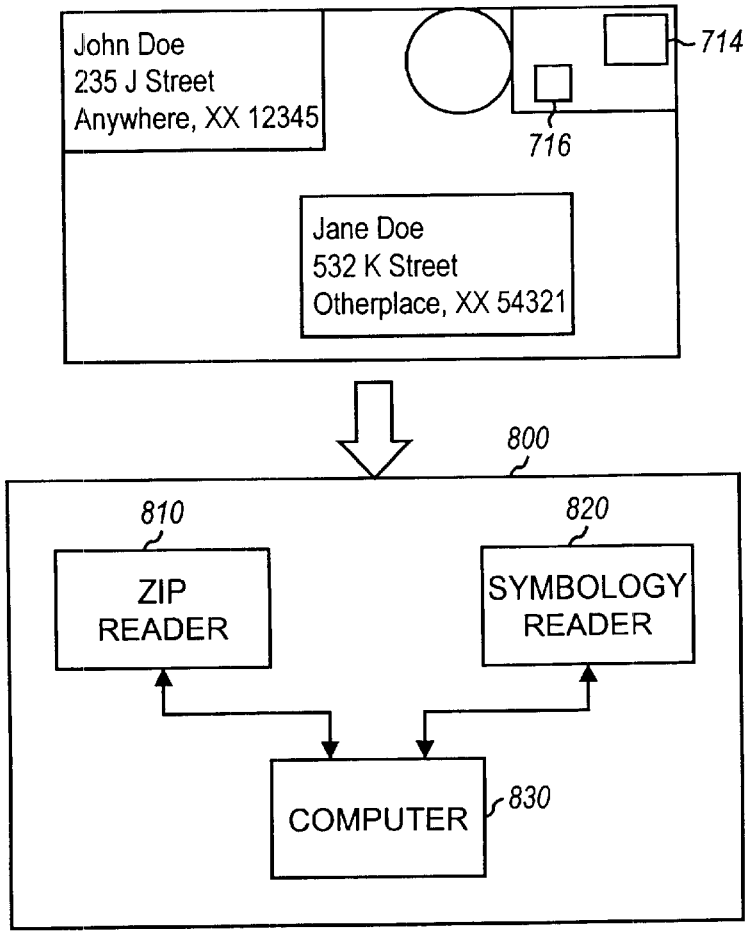
FIG. 8 shows a block diagram of an embodiment of an authentication system for the detection of fraudulent postage indicia.

FIG. 8 shows a block diagram of an embodiment of an authentication system 800 for the detection of fraudulent postage indicia. A ZIP reader 810 reads human-readable postage information 714 and a symbology reader 820 reads encoded postage information 716 from a postage label. This information is passed to a computer 830 that decodes or decrypts the encoded postage information. Alternatively or in addition, computer 830 may authenticate the information retrieved from the postage label. Computer 830 can authenticate by either verifying the digital signatures or by comparing the decoded data with the un-encoded data from the postage label. Other information may be provided by the user to aid in the authentication of the postage indicium.

Aside from the advantage of using a small print area, the encrypted data (i.e., using the data matrix format) can also provide two levels of security. First, decoding the encrypted data typically requires a special data detection mechanism, or at least an understanding of the techniques involved. Second, even if the printed data is captured and decoded, encryption can be used to prevent viewing of any or all data contents. Thus, this authentication system meets the requirement for a secure and accurate means of authenticating postage indicia.

The foregoing description of the specific embodiments is provided to enable any person skilled in the art to make or use the present invention. Various modifications to these embodiments will be readily apparent to those skilled in the art, and the generic principles defined herein may be applied to other embodiments without the use of the inventive faculty. For example, digital signatures, encryption (e.g., DES, RSA, and others), and other coding techniques can be incorporated with the present invention. Thus, the present invention is not intended to be limited to the embodiments shown herein but is to be accorded the widest scope consistent with the principles and novel features disclosed herein.

What is claimed is:

1. A postage metering system, comprising:

a computer having an interface to receive postage information;

a docking station coupled to the computer; and a postage metering device operatively coupled to the computer via the docking station, the postage metering device including a secure metering device (SMD) configured to store accounting information, wherein:

the postage metering device is removably coupled to the docking station, the postage metering device is characterized at least by a docked operating mode and an undocked operating mode, the docked operating mode corresponding to the postage metering device being coupled to the computer and the undocked operating mode corresponding to the postage metering device being uncoupled from the computer, funding of the postage metering device is performed in the docked operating mode, and the postage metering device is configured to print indicia having a predetermined value when operating in the undocked operating mode.

2. The system of claim 1, wherein the predetermined value is set when the postage metering device operating in the docked operating mode.

3. The system of claim 1, wherein the docking station includes a set of pass-through interconnects that couple the postage metering device to the computer.

4. The system of claim 1, wherein the docking station includes active circuitry that provides buffering or translation of signal levels, or both, of signals between the postage metering device and the computer.

5. The system of claim 1, wherein the postage metering device further includes:

a first interface for coupling to the computer; and a second interface for coupling to an external device.

6. The system of claim 1, wherein the postage metering device further includes:

an input mechanism configured to receive user input.

7. The system of claim 1, wherein the SMD includes revenue registers configured to store the accounting information;

a processor configured to receive the accounting information, direct generation of an indicium having a particular value, and account for the particular indicium value; and an enclosure that houses the processor and the revenue registers.

8. The system of claim 1, wherein the SMD is housed in an enclosure that is removably coupled to the postage metering device.

9. The system of claim 8, wherein the SMD is housed in a smartcard.

10. The system of claim 1, wherein the postage metering device further includes:

a printer coupled to the SMD, the printer configured to receive and print an indicium.

11. The system of claim 10, wherein the computer, the docking station, the SMD, and the printer are coupled in a daisy chain.

12. The system of claim 10, wherein the SMD and the printer are housed in a portable housing.

13. A postage metering system comprising:

a computer having an interface to receive postage information;

a docking station coupled to the computer; and a postage metering device operatively coupled to the computer via the docking station, wherein the postage metering device is characterized at least by a docked operating mode and an undocked operating mode, the docked operating mode corresponding to the postage metering device being coupled to the computer and the undocked operating mode corresponding to the postage metering device being uncoupled from the computer, the postage metering device including a secure metering device (SMD) configured to store accounting information, a printer coupled to the SMD, the printer configured to receive and print an indicium, and a portable enclosure for housing the SMD and the printer, wherein funding of the postage metering device is performed in the docked operating mode, wherein the postage metering device is configured to print indicia having a predetermined value when operating in the undocked operating mode, wherein the postage metering device is removably coupled to the docking station.

14. A postage metering system comprising:

a computer having an input interface to receive postage information;

a plurality of postage metering devices, each postage metering device including first and second interface ports, and a secure metering device (SMD) configured to store accounting information, wherein each postage metering device is configured for coupling to at least one external device via the interface ports, the at least one external device being the computer or other postage metering device, or both, wherein funding of a particular postage metering device is performed when the particular postage metering device is coupled to the least one external device, and wherein the particular postage metering device is configured to print indicia having a predetermined value when uncoupled from the at least one external device.

15. The system of claim 14, wherein each postage metering device further includes a printer coupled to the SMD, the printer configured to receive and print an indicium.

16. The system of claim 14, wherein the SMD is removably coupled to the postage metering device.

17. The system of claim 14, wherein the computer or one of the plurality of postage metering devices is designated as a master unit and remaining postage metering devices are designated as satellite units, wherein funding of the satellite units is provided from funds stored in the master unit.

18. The system of claim 17, wherein funding of the master unit is limited to a first predetermined value and funding of each satellite unit is limited to a second predetermined value, wherein the first predetermined value is higher than the second predetermined value.

19. The system of claim 17, wherein funding of a particular satellite unit is performed when the particular satellite unit is coupled to a set of one or more designated master units.

20. A postage metering device comprising:

an interface port;

a secure metering device (SMD) that includes a memory element configured to store accounting information, and a processor operatively coupled to the memory element, wherein the processor is configured to receive a message, process the message to generate an indicium, and update the accounting information to account for the generated indicium, and an enclosure that houses the memory element and the processor;

a printer coupled to the SMD, the printer configured to receive and print the indicium;

an enclosure that houses the interface port and the printer, wherein the SMD removably couples to the interface port of the postage metering device, wherein the postage metering device is removably coupleable to a computer, wherein funding of the postage metering device is performed when coupled to the computer, and wherein the postage metering device is configured to print indicia having a predetermined value when uncoupled from the computer.

21. A method of generating postage indicia, comprising the acts of:

coupling a postage metering device to a computer;

funding the postage metering device with a funded amount via the computer;

setting a predetermined value of an indicium via the computer;

uncoupling the postage metering device from the computer;

generating, with the uncoupled postage metering device, one or more indicia having the predetermined value, wherein a quantity of the indicia generated is limited by the funded amount;

coupling the postage metering device to the computer; and funding the postage metering device with an additional funded amount via the computer.

* * * * *